US011519164B1

(12) United States Patent
Crevier

(10) Patent No.: US 11,519,164 B1
(45) Date of Patent: Dec. 6, 2022

(54) URINAL SCREEN FORMED WITH FOLD LINES

(71) Applicant: Jeffrey Scott Crevier, Fort Lauderdale, FL (US)

(72) Inventor: Jeffrey Scott Crevier, Fort Lauderdale, FL (US)

( * ) Notice: Subject to any disclaimer, the term of this patent is extended or adjusted under 35 U.S.C. 154(b) by 0 days.

(21) Appl. No.: 17/573,359

(22) Filed: Jan. 11, 2022

(51) Int. Cl.
*E03D 13/00* (2006.01)

(52) U.S. Cl.
CPC ..... *E03D 13/005* (2013.01)

(58) Field of Classification Search
CPC ..... E03D 13/005; E03D 13/007; A47K 1/06
See application file for complete search history.

(56) References Cited

U.S. PATENT DOCUMENTS

| | | | | |
|---|---|---|---|---|
| 4,671,976 | A | 6/1987 | Vidal | |
| 4,866,793 | A | 9/1989 | Luedtke et al. | |
| D329,893 | S | 9/1992 | Luedtke et al. | |
| 5,313,672 | A | 5/1994 | Luedtke et al. | |
| 5,398,347 | A | 3/1995 | Luedtke et al. | |
| D393,896 | S | 4/1998 | Wagner et al. | |
| 5,774,905 | A | 7/1998 | Wager et al. | |
| 5,809,590 | A | 9/1998 | Williams et al. | |
| D427,295 | S | 6/2000 | Wagner | |
| 6,550,075 | B1 | 4/2003 | Brannon, III | |
| D639,410 | S | 6/2011 | Ramirez | |
| 8,043,498 | B2 | 10/2011 | Rueda | |
| 8,056,153 | B2 | 11/2011 | Ruedas | |
| D678,482 | S | 3/2013 | Williams | |
| 8,856,976 | B1 | 10/2014 | Niedzielski, III | |
| 8,856,977 | B2 | 10/2014 | Ramirez | |
| 9,309,658 | B1 * | 4/2016 | Pernici | E03D 13/005 |
| D787,031 | S | 5/2017 | Morgan-Williams | |
| 10,036,154 | B2 | 7/2018 | Crevier | |
| 10,145,098 | B2 | 12/2018 | Brown et al. | |
| 10,294,649 | B2 | 5/2019 | Crevier | |
| 2004/0093662 | A1 | 5/2004 | Zhu | |
| 2013/0000027 | A1 | 1/2013 | San Luis et al. | |
| 2015/0047114 | A1 | 2/2015 | Ramirez | |
| 2015/0143624 | A1 | 5/2015 | Irving | |
| 2016/0122992 | A1 * | 5/2016 | Brown | E03D 9/007 4/256.1 |
| 2019/0292764 | A1 * | 9/2019 | Crevier | E03D 13/005 |

OTHER PUBLICATIONS

Examination Report from the European Union Intellectual Property Office dated Oct. 4, 2018, pp. 1-5.

* cited by examiner

*Primary Examiner* — Janie M Loeppke
(74) *Attorney, Agent, or Firm* — The Concept Law Group, PA; Scott D. Smiley; Scott M. Garrett

(57) ABSTRACT

A urinal screen has a kite-shaped body having a longitudinal axis about which the body is symmetric, and a crosswise axis at a right angle to the longitudinal axis. There is at least one crosswise fold line formed in the body in which extended openings are formed along the crosswise axis, and there is at least one longitudinal fold line formed parallel to the longitudinal axis by extended openings through the body. The lack of material along the fold lines, relative to other portions of the body, facilitate bending or folding along these lines to conform to the shape of various urinal basins.

20 Claims, 9 Drawing Sheets

URINAL SCREEN FORMED WITH FOLD LINES

FIELD OF THE INVENTION

The present invention relates generally to urinal screens that reduce splash, and, more particularly, relates to a urinal screen configured to allow the urinal screen to adapt to various urinal basin shapes.

BACKGROUND OF THE INVENTION

A urinal, often installed for efficiency when compared to a general purpose toilet, is a sanitary plumbing fixture commonly located in male restrooms. The use of a urinal, in comparison to a general purpose toilet, is often more convenient for a user due to the absence of additional doors and locks. As an added convenience, urinals do not require a user to turn up a seat prior to use, which is both convenient and generally more sanitary than the toilet. Moreover, urinals occupy less space and consume less water per flush, or possibly no water at all, than a toilet which requires flushing.

Devices designed to be placed within urinals are well-known. For example, urinals found in public restrooms often have a plastic mesh guard to prevent large debris from entering the drain. Unfortunately, such plastic mesh guards fail to reduce or prevent the splashing of urine onto the user. In fact, such plastic mesh guards may actually increase the risk of the user being splashed by the urine as the urine ricochets from the plastic mesh guard. Moreover, these plastic mesh guards do not prevent the splashing of urine that is directed towards the back wall of the urinal.

Other known devices designed to be placed within urinals, often referred to as urinal screens or occasionally as urinal screens, are sized and shaped to cover either the urinal's back wall or the drain. Such urinal screens do not allow the user the option of covering both the back wall and the drain to prevent the urine from splashing onto the user from a maximum surface area of the urinal. Moreover, some urinal screens are made of a rigid material that may fail to conform to the various sizes and shapes of urinals.

Additional known devices designed for placement within a urinal often include protrusions that are densely compacted together, preventing a urine stream from flowing in a vertical direction toward the urinal screen. In this vein, such devices rely on the protrusions to break up the urine stream, leaving urine deposited on the protrusions, resulting in an unpleasant odor and the need for increased cleaning frequency of the device. Moreover, many urinal screens include urinal cakes or deodorizers which require costly and frequent replacement.

A particular problem with urinal design with respect to the design of mats or screens to prevent splashing in urinals is the variety of shapes in which urinals configured. For example, some urinals have rounded basins, while others have a narrower, more pointed basin. Accordingly, to optimize the anti-splash aspect of a urinal screen, it must fit properly in the basin. As a result, there are a similar variety of urinal screens provided for variously shaped urinal basins. However, this necessitates different molding tools to manufacture the different urinal screen shapes, it requires stocking the different urinal screen devices, and so on.

Therefore, a need exists to overcome the problems with the prior art as discussed above.

SUMMARY OF THE INVENTION

In accordance with some embodiments of the inventive disclosure, there is provided a urinal screen that includes a body sheet having a kite shape and including a perimeter defining a front apex, a rear apex, a first side apex, and a second side apex. There is a longitudinal axis defined from the front apex to the rear apex, and a crosswise axis defined from the first side apex to the second side apex. The longitudinal axis and the crosswise axis are at a right angle to each other, and the body sheet is symmetric about the longitudinal axis and asymmetric about the crosswise axis. The crosswise axis is closer to the rear apex than to the front apex, and the body sheet is formed of a material that is flexible. The urinal screen further includes an interior of the body sheet formed as a web of openings through the body sheet that are each bounded by intersecting lines of material. The intersecting lines of material also form a plurality of nodes where the lines of material intersect, and a plurality of links between nodes along sides of openings. The urinal screen further includes a plurality of protrusions formed on the lines of material on a top side of the body sheet, and a crosswise fold line formed along the crosswise axis wherein portions of the lines of material are broken along the crosswise fold line.

In accordance with further feature, there is also included at least one longitudinal fold line formed parallel to the longitudinal axis wherein portions of the lines of material are broken along the at least one longitudinal fold line.

In accordance with further feature, the at least one longitudinal fold line includes two longitudinal fold lines include a first longitudinal fold line and second longitudinal fold line. The first and second longitudinal fold lines are located on opposite sides of the longitudinal axis and are equidistant from the longitudinal axis.

In accordance with further feature, the plurality of protrusions include a first plurality of protrusions wherein each protrusion of the first plurality of protrusions is located at a respective one of the plurality of nodes, and a second plurality of protrusions wherein each protrusion of the second plurality of protrusions is located at a respective one of the plurality of links.

In accordance with further feature, the first plurality of protrusions have a first height, the second plurality of protrusions have a second height, and wherein the first height and the second height are different.

In accordance with further feature, each of the openings has a regular rhombus shape and each of the openings are commonly oriented.

In accordance with further feature, there is also included, on a bottom side of the body sheet, opposite the top side of the body sheet, at least one forward diverter wall that extends from the bottom side of the body sheet along the longitudinal fold line between the crosswise fold line and the front apex, and at least one rearward diverter wall that extends from the bottom side of the body sheet along the longitudinal fold line between the crosswise fold line and the rear apex. There is further included a suction cup support positioned along the longitudinal axis between the at least one rearward diverter wall and the rear apex that includes a support wall that extends from the bottom side of the body sheet to a tab that extends away from the support wall in a direction towards the rear apex.

In accordance with further feature, there is also included at least two forward standoffs extending from the bottom side of the body sheet between the crosswise fold line and the front apex and on opposite sides of the longitudinal fold lines, and at least two rearward standoffs extending from the bottom side of the body sheet between the crosswise fold line and the rear apex and on opposite sides of the longitudinal fold lines. The at least two rearward standoffs extend farther from the bottom side of the body sheet than the at least two forward standoffs.

In accordance with some embodiments of the inventive disclosure, there is provided a urinal screen that includes a body sheet having a kite shape including a perimeter. The perimeter defines a front apex, a rear apex, a first side apex, and a second side apex. There is a longitudinal axis defined from the front apex to the rear apex, and a crosswise axis defined from the first side apex to the second side apex, wherein the longitudinal axis and the crosswise axis are at a right angle to each other. The body sheet is symmetric about the longitudinal axis and asymmetric about the crosswise axis and the crosswise axis is closer to the rear apex than to the front apex. The body sheet is formed of a flexible material. The front apex is rounded, and the perimeter between the first side apex and a first side of the front apex curves inward relative to a straight line between the first side apex and the first side of the front apex, and the perimeter between the second side apex and a second side of the front apex curves inward relative to a straight line between the second side apex and the second side of the front apex. The urinal screen further includes an interior of the body sheet that is formed of a web of openings through the body sheet bounded by intersecting lines of material forming a plurality of nodes where lines of material intersect and a plurality of links between nodes along sides of openings. The urinal screen further includes a plurality of protrusions formed on the lines of material on a top side of the body sheet, and a crosswise fold line formed parallel to the crosswise axis wherein portions of the lines of material are broken along the crosswise fold line.

Although the invention is illustrated and described herein as embodied in a urinal screen, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the longitudinal axis. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
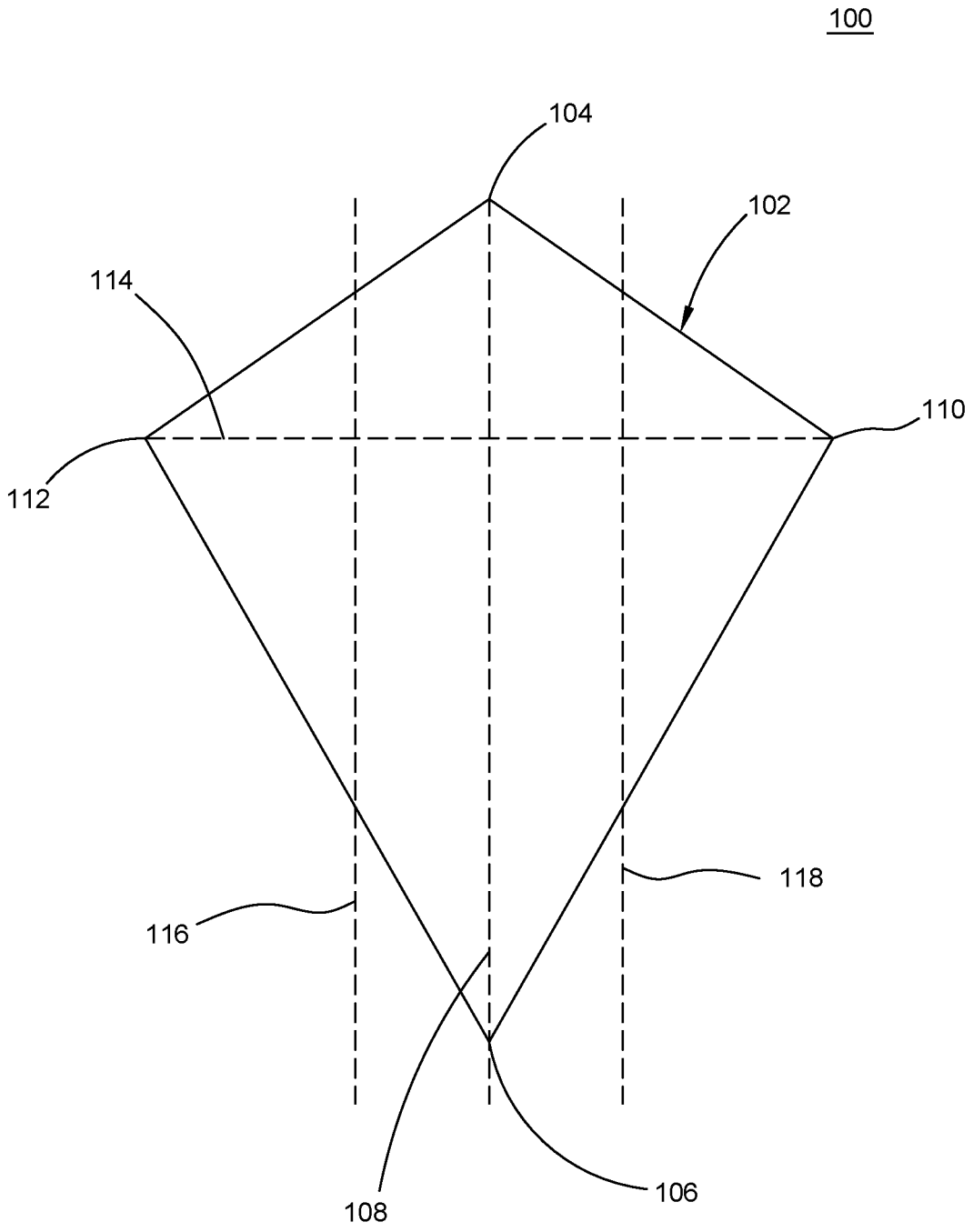
FIG. 1 shows a plan view of a kite-shaped urinal screen have fold lines, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 shows a plan view of a kite-shaped urinal screen 100 having fold lines, in accordance with some embodiments. The urinal screen 100 includes a kite-shaped body 102 that has a rear apex 104 and a front apex 106 that define a longitudinal axis 108. The body 102 further includes a right side apex 110 and a left side apex 112 between which a crosswise axis 114 is defined that is at a right angle to the longitudinal axis 108. Being kite-shaped, the crosswise axis 114 is closer to the rear apex 104 than it is to the front apex 106. Further, the body 102 is symmetric about the longitudinal axis 108, and asymmetric about the crosswise axis 114. A pair of longitudinal fold lines 116, 118 are shown on opposite sides of the longitudinal axis 108, offset by equal distances from the longitudinal axis 108. A crosswise fold line can be defined along the crosswise axis 114. The fold lines 114, 116, 118 are lines along which the urinal screen 100 is configured to bend in order to allow the urinal screen 100 to conform to various urinal basin shapes.

In general, the body 102 is sheet-like, having a top side on one major surface, and the bottom side opposite the top side forming another major surface, wherein the body 102 has a perimeter that is bounded along the sides of the kite-shape. When placed into a urinal basin, the rear apex 104 is placed at the rear of the basin and the front apex is placed at the front of the basin, which will be closest to the user. Although shown here with a crosswise fold line along the crosswise axis 114, the crosswise fold line can be parallel to, but offset from the crosswise axis in some embodiments, on the rear or front side of the crosswise axis (i.e. closer to the rear apex 104 or the front apex 106). Further, there can be more than one crosswise fold line. In some embodiments it is contemplated that there may be a single longitudinal fold line along the longitudinal axis 108.

The urinal screen 100 represents an abstraction to clearly show the major features of the urinal screen being disclosed in accordance with embodiments of the invention. In particular, the urinal screen 100 of the inventive disclosure includes a kite-shaped body 102, with at least one crosswise fold line and at least one longitudinal fold line. In addition to the fold line features, the urinal screen can include anti-splash protrusions that extend from the top side and are disposed around openings through the body 102 that allow fluid from a fluid stream incident on the urinal screen to pass through the body and reduce splashing of the fluid. The bottom side of the urinal screen (opposite that in view here) can include features intended to raise the body of the urinal screen off the surface of the urinal basin to allow fluid to flow under the urinal screen into the urinal drain. These and other features will be shown in the subsequent illustrations.

Figure 2:
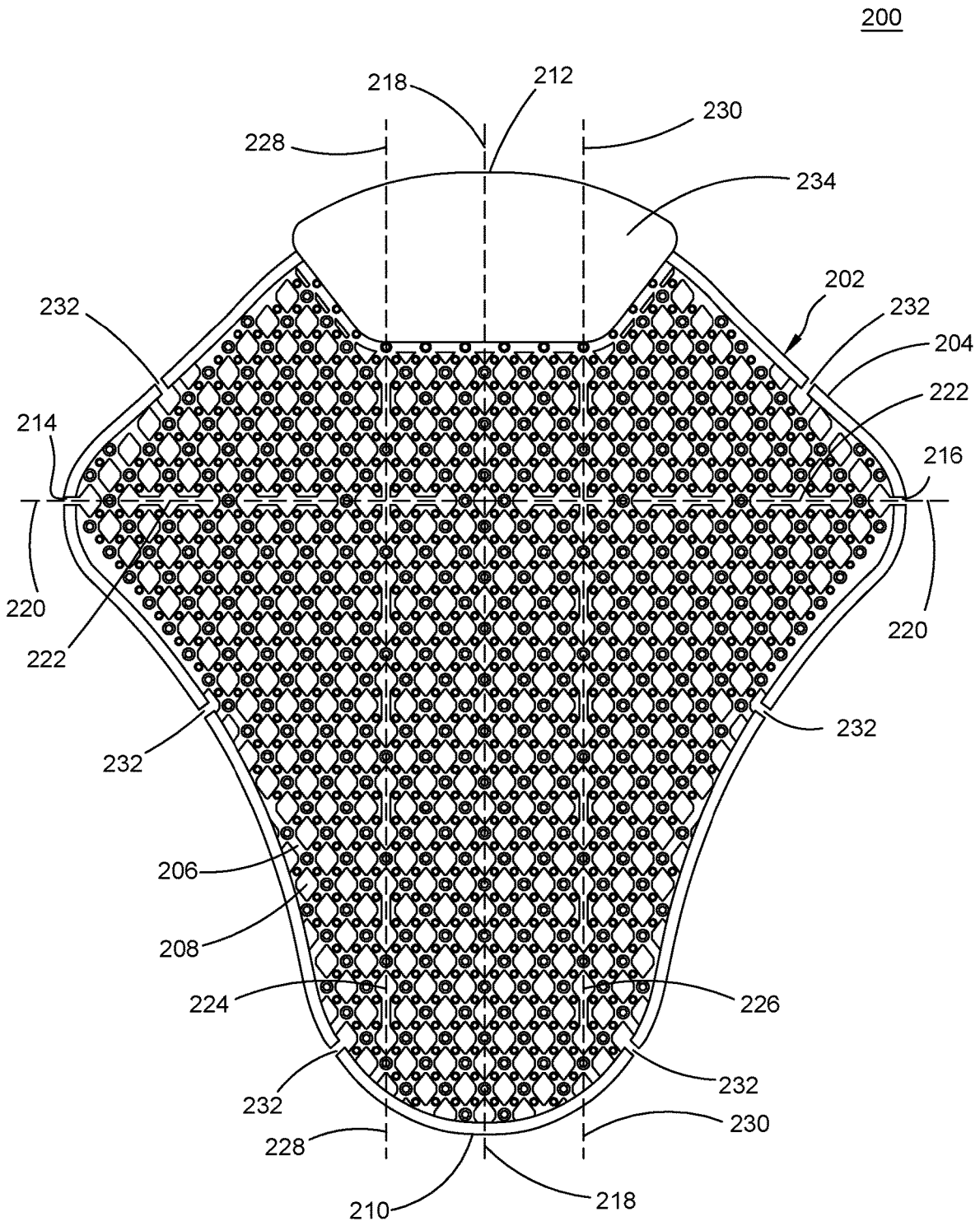
FIG. 2 shows a top plan view of a urinal screen having a kite-shaped body and that has longitudinal and crosswise fold lines, in accordance with some embodiments.

FIG. 2 shows a top view of a urinal screen 200 having a kite-shaped body sheet or simply body 202 and that has longitudinal and crosswise fold lines, in accordance with some embodiments. The urinal screen 200 incorporates the major features described in relation to urinal screen 100 of FIG. 1, and includes other features and refinements not shown in FIG. 1. The body 202 includes a perimeter that has a boundary 204 that bounds a web made up of lines of material 206. The boundary 204 is a thin region of material around the perimeter that that the web of lines are connected to. Around the border 204 there can be breaks 232 that compensate for shrinkage over time as fragrance oil is emitted from the material. The lines of material 206 include at least one set of lines of material 206 arranged in a first direction, and other lines arranged in a second direction within the sheet-like body 202. Both sets of lines are arranged at a regular spacing which results in the line intersecting at nodes and defining openings 208 through the body 202.

Figure 3:
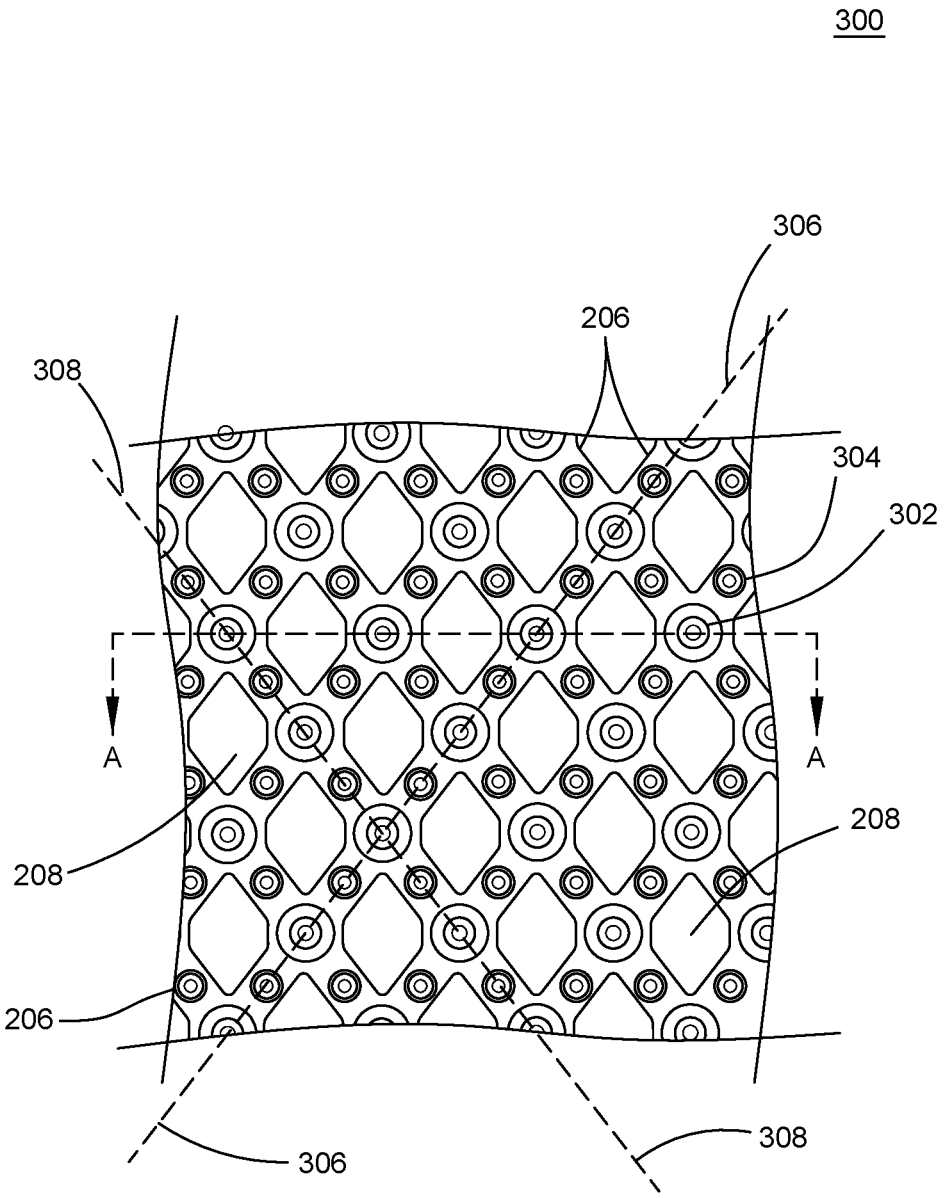
FIG. 3 shows a detail of the web of the body of a urinal screen having intersecting lines of material that define openings through the body of the urinal screen, in accordance with some embodiments.
Figure 4:
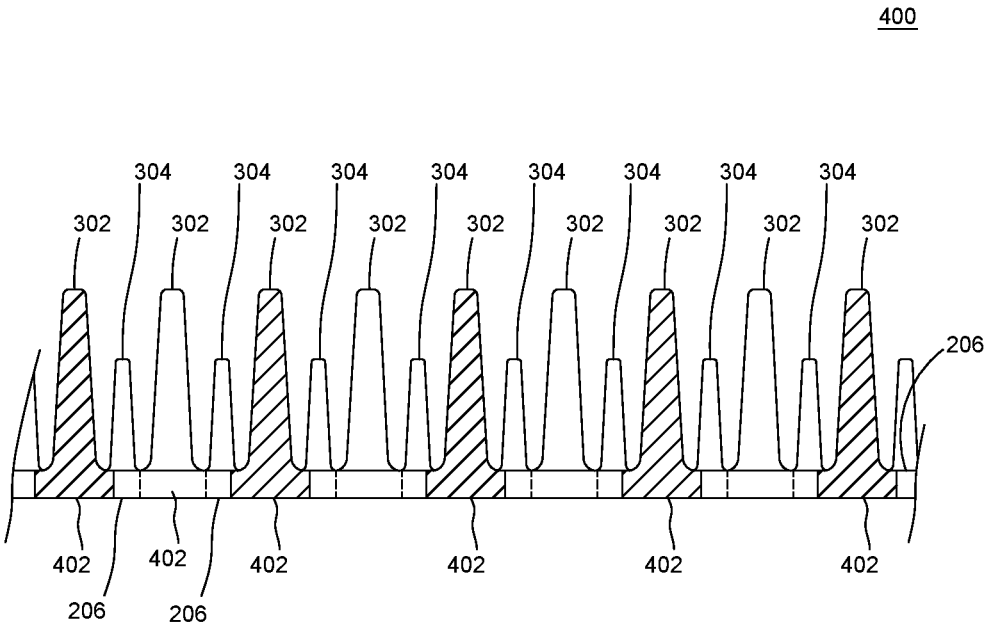
FIG. 4 shows a side cutaway view of FIG. 3 taken along line A-A.

FIG. 3 shows a detail view 300 of the web of the body, including lines of material 206 formed along or parallel to intersecting lines 306, 308 at regular spacing across the body 202. Located on the lines of material 206 are protrusions 302, 304. The protrusions 302 can be located at the intersections of lines (nodes) and protrusions 304 can be located on the lines (links) between the intersections of the lines. As shown here, lines 306, 308 are not at right angles to each other, and as a result, the openings 208 have a generally rhombus shape. FIG. 4 shows a side cutaway view 400 of detail of FIG. 3 taken along line A-A. In this view it can be seen that there are two sets of protrusions, a first set 302 having a first height, and second set 304 having a second height. The protrusions in general extend away from the top surface of the body, and can be integrally formed/molded of same material as the body. The taller protrusions 302 can be located at the nodes 402 where lines 206 intersect, and the shorter protrusions 304 can be located on the links, which are the portions of the lines 206 between the nodes 402. Varying the height of the protrusions as shown has been found to be more effective in reducing splash of a fluid stream incident on the urinal screen than if the protrusions are all the same height. The protrusions 302, 304 can be conical in shape, having a generally round body that tapers in diameter from the base, where they are joined with the lines 206, to a tip at the distal end of the protrusions.

Returning now to FIG. 2, the body 202 has a front apex 210 and a rear apex 212 which define a longitudinal axis 218 between the front apex 210 and rear apex 212. The front apex is the forward or front-most region and can be curved/radiused as shown, or more pointed as in FIG. 1. Likewise, the rear apex 212 is further to the rear of the body 202 and can have a larger radius of curvature than the front apex 210, or can also be more pointed. The body further has a first side apex 214 and a second side apex 216 that define a crosswise axis 220 that is at right angle to the longitudinal axis 218. The body 202 is symmetric about the longitudinal axis 218 and asymmetric about the crosswise axis 220 with the crosswise axis 220 being closer to the rear apex 212 than it is to the front apex 210.

A crosswise fold line can be formed along the crosswise axis 220 by breaking the lines of material 202 at points along the crosswise axis to form extended openings 222, where the nodes 402 of material are removed at one or more intersection points on the crosswise axis 220. In the example shown, the extended openings are formed by breaking the intersecting points at two consecutive locations along the crosswise axis. As used here, "breaking" and "broken" means that there is an absence of material along a line of material that results in adjacent ones of the openings being joined to form an extended opening, which can be created by the shape of a mold used to form the urinal screen, and does not necessarily mean that a person, for example, uses to tool to break the connections. In other words, the lines of material are broken at the crosswise axis 220 at certain locations to create the extended openings 222. However, not all of the node points on the crosswise axis 220 are broken, thus there are a plurality of extended openings 222 alternating with joined sections of the intersecting lines 206.

Figure 5:
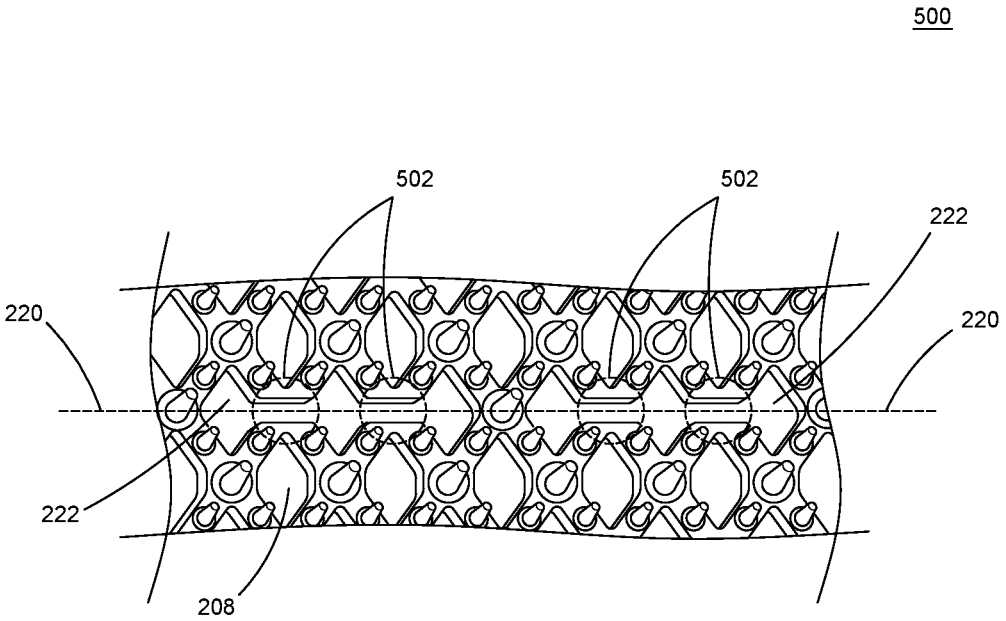
FIG. 5 shows a detail view of a portion of the crosswise fold line between the right and left side apexes, in accordance with some embodiments.
Figure 6:
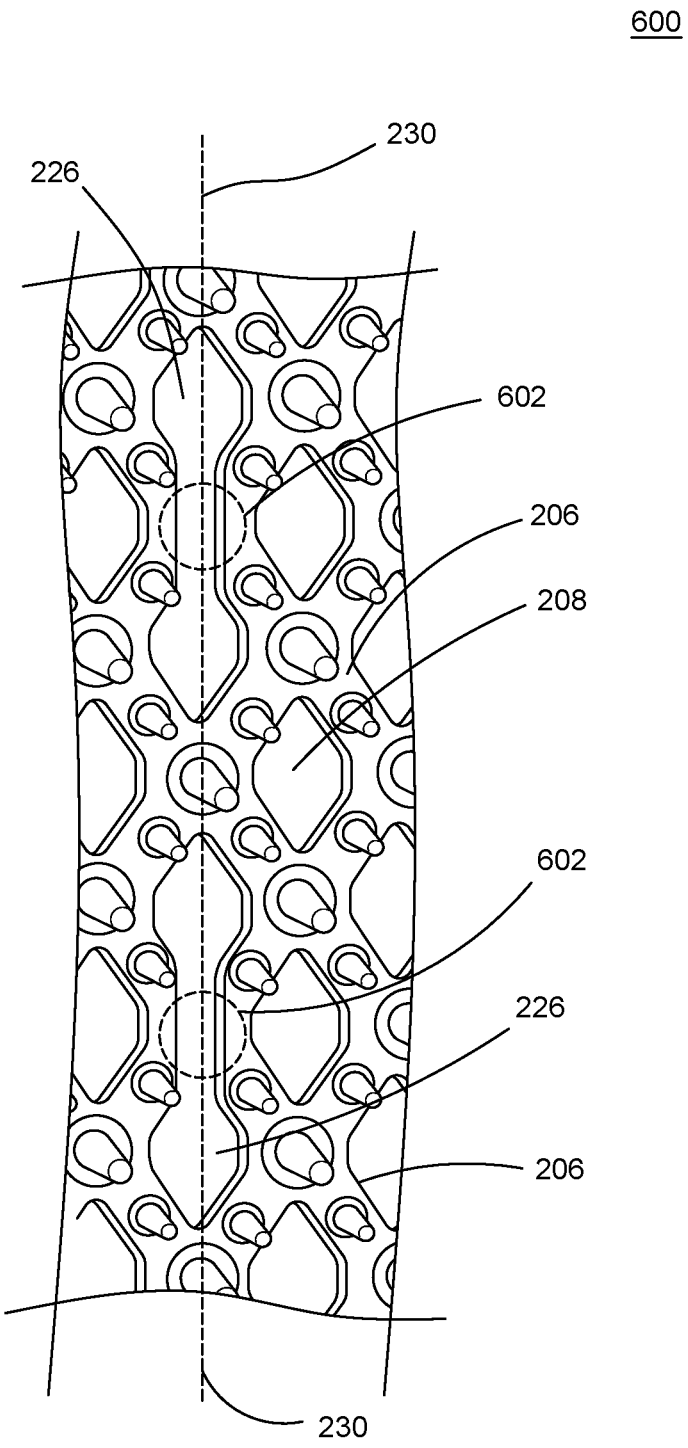
FIG. 6 shows a detail view of a portion of a longitudinal fold line, in accordance with some embodiments.

Likewise, there are longitudinal fold lines 228, 230 that are parallel to the longitudinal axis 218, and offset from the longitudinal axis 218. The longitudinal fold lines 228, 230 are formed by broken section of the intersecting lines 206 that create extended openings 226, which can intersect with the crosswise extended openings 222 along the crosswise axis 220. As with the crosswise fold lines, the extended openings 226 have non-broken portions between them along the longitudinal fold lines 228, 230. Thus, both the crosswise fold lines and longitudinal fold lines 228, 230 facilitate bending or folding of the body 202 along these lines due to the lack of material along the fold lines relative to other portions of the body 202. FIG. 5 shows a detail view of a portion of the crosswise fold line along the crosswise axis 222, between the right and left side apexes. As can be seen the extended openings 222 are formed by breaks in regions 502 that joins consecutive openings 208 together so that three openings are joined (open) together in each of the extended openings 222. Similarly, in FIG. 6 there is shown a detail view of a portion of a longitudinal fold line 230, in which extended openings 226 are formed by breaks 602 in the lines 206 to result in consecutive openings 208 being joined (open) together. Furthermore, to match the curvature of some urinal basins, the perimeter along the border can curve inward along the sections between the side apexes 214, 216 and the front apex, relative to a straight line between those apexes.

Figure 7:
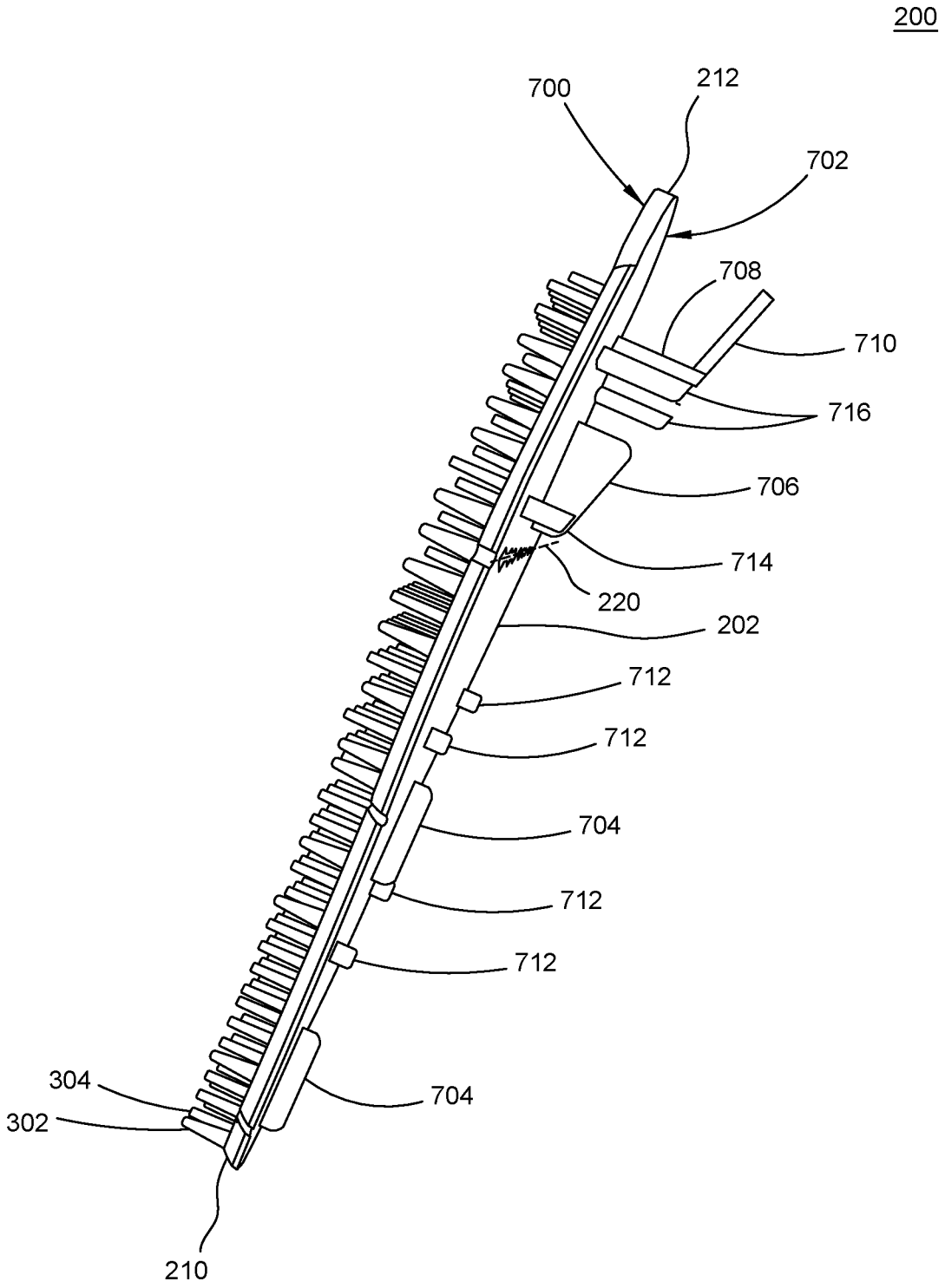
FIG. 7 shows a side view of a urinal screen, in accordance with some embodiments.
Figure 8:
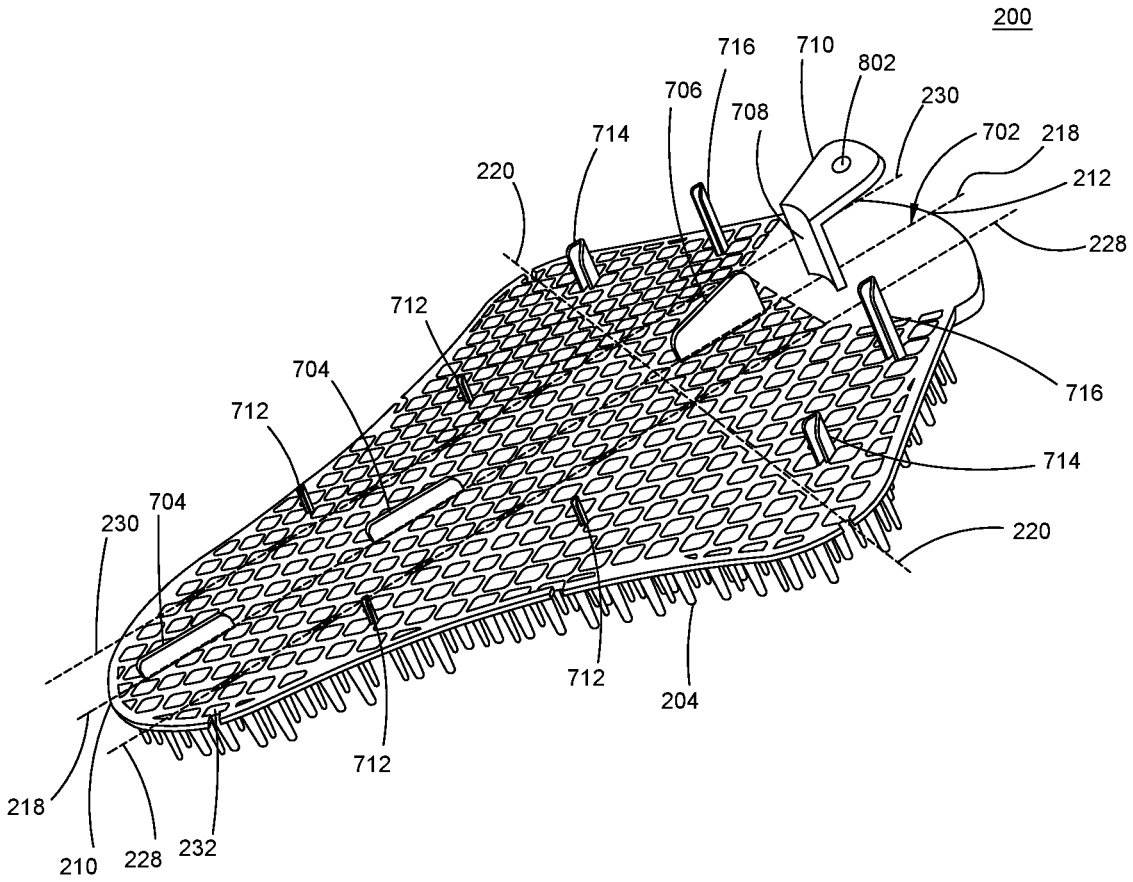
FIG. 8 shows a rear perspective view of the bottom side of a urinal screen having fold lines, in accordance with some embodiments.

FIG. 7 shows a side view of the urinal screen 200, in which the body 202 has a top side 700 and a bottom side 702. FIG. 8 shows a rear perspective view of the bottom side 702 of a urinal screen 200. The plurality of protrusions (e.g. 302, 304) extend from the top side 700. On the bottom side 702 there are one or more forward diverter walls 704 which are located between the crosswise axis 220 and the front apex 210 along the longitudinal axis. The forward diverter wall(s) 704 can have a uniform height relative to the bottom side 702 of the body 202. one or more rearward diverter walls 706 can be located along the longitudinal axis 218 between the crosswise axis 220 and the rear apex 212, and have a varying height that increases along the rear diverter wall 706 towards the rear. Further a suction cup support can be provided that includes a support wall 708 and a tab 710 that extends from the support wall 708. The support wall 708 extends from the bottom side, and the tab extends from a top of the support wall toward the rear, and comprises a relative flat portion. A hole 802 can be provided through which the anchor of a suction cup can be placed, allowing the use of a suction cup to hold the urinal screen 200 in place in a urinal basin. One or more forward standoffs 712 and rearward standoffs 714, 716 can be provided on the bottom side 702 between the crosswise axis 220 and the rear apex 212. The rearward standoffs 714 are shorter than rearward standoffs 716, and the difference in height of these standoffs 714, 716 follows the angle (relative to the surface of the bottom side 702) of the top of the rearward diverter wall 706 and the angle of the tab 710. The angle of the rearward elements (e.g. 706, 710, 714, 716) is intended to optimize the angle of the rearward portion of the urinal screen body 202 (e.g. from the crosswise axis 220 to the rear apex 212) relative to the forward portion (e.g. between the front apex 210 and the crosswise axis 220) when the urinal screen is placed in a urinal basin as these features will be in contact with the surface of the basin.

In some embodiments there can be a flat region 234 proximate to the rear apex 212 on which printing can be placed (i.e. branding). The flat region 234 lacks protrusions or openings on or through the body. The support wall 708 can extend from the flat region at the bottom side 702.

Figure 9:
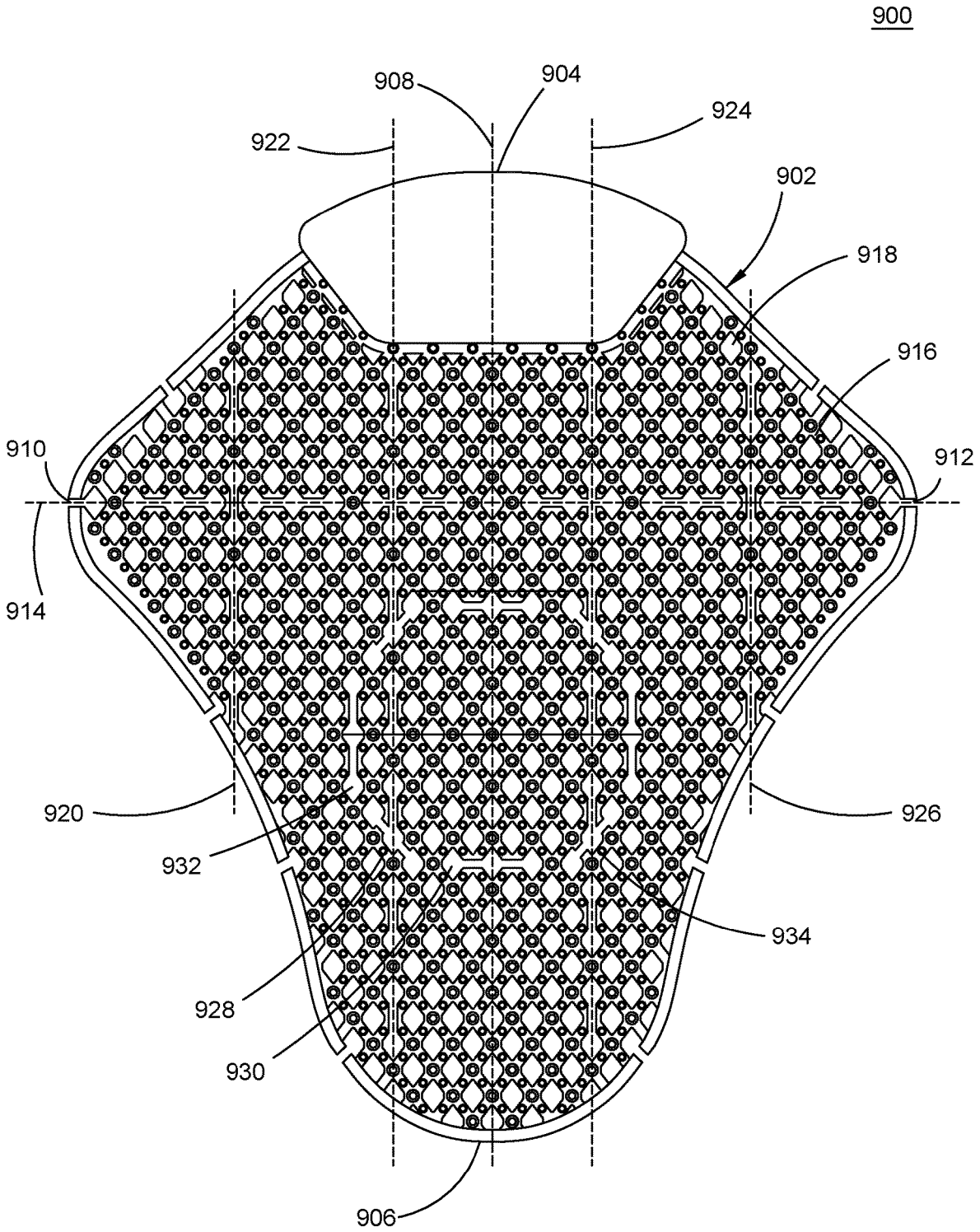
FIG. 9 shows a top plan view of a urinal screen having a kite-shaped body and that has longitudinal and crosswise fold lines, in accordance with some embodiments.

FIG. 9 shows a top plan view of a urinal screen 900 having a kite-shaped body 902 and that has longitudinal and crosswise fold lines, in accordance with some embodiments. The kite-shaped body 902 is an alternative to that of FIG. 2, and is optimized for certain urinals over that of the specific shape of the body shown in FIG. 2. The kite shaped body 902, like that of FIG. 2, includes a border to which diagonal lines of material 916 join. The lines of material 916 include lines in both diagonal directions and define openings 918 between the lines of material 916 and have protrusions of alternating heights on them. The lines of material 916 can be oriented such that the openings each generally have a rhombus shape that can be non-square. The body 902 has a rear apex 904 and a front apex 906 that define a longitudinal axis 908. The body further has a first side apex 910 and a second side apex 912 that define a crosswise axis 914 the is perpendicular to the longitudinal axis 908. The kite shape of the body is created by the body being symmetric about the longitudinal axis 908 and asymmetric about the crosswise axis 914 such that the rear apex 904 is closer to the crosswise axis 914 than the front apex 906 is to the crosswise axis 914.

In the present exemplary embodiment the body 902 includes two longitudinal fold lines 920, 922 and 924, 926 on each side of the longitudinal axis 908. As in the prior embodiments, the fold lines are created by omitting material between adjacent openings 918 along the fold lines to join the openings into extended openings in the longitudinal direction (to create longitudinal fold lines). In some embodiments every other link of material 916 is omitted between openings forming successive extended openings along the longitudinal fold lines 920, 922, 924, 926. In some embodiments there can be longitudinal fold lines 922, 924 that about one quarter of the distance between the longitudinal axis 908 and the respective side apexes 910, 912. These can be referred to as the inner longitudinal fold lines 922, 924. Outer longitudinal fold lines 920, 926 can be about two thirds of the distance from the longitudinal axis 908 to the respective apexes 910, 912. A crosswise fold line is similarly formed along the crosswise axis 914 by omitting some of the links of material on the crosswise axis 914 to join adjacent openings 916 into extended openings. Furthermore, a generally circular arrangement of extended openings is formed centered on the longitudinal axis 908 between the front apex 906 and the crosswise axis 914 by crosswise extended openings 930, longitudinal extended openings 932, and diagonal extended openings 928, 934. The pattern here can also be described as being octagonal, but it is generally regular polygon approximating a circle. These extended openings 928, 930, 932, 934 each join three adjacent openings in succession along a line. The diagonal extended openings 928, 934 can also be joined to a fourth opening from their central opening on the diagonal line. The generally circular pattern of extended opening 928, 930, 932, 934 allow relief in the center of the body 902 for features, either fixed or added, that may be found in the bottom of a urinal, such as a drain domed drain cover. In general, it has been found that the urinal screen 900 provides advantages in certain urinal designs over that of urinal screen 200, and vice versa. Further, the bottom side of the urinal screen 900 can be substantially similar to that shown in FIGS. 7-9, with forward standoffs 712, rearward standoffs 714, 716 of increasing height toward the rear apex 904, diverter walls 704, 706 and the suction cup support 710.

A urinal screen has been disclosed that include a kite-shaped body sheet, with fold lines that pass parallel to a symmetric axis and which pass at a right angle to those. The symmetric axis is a longitudinal axis about which the urinal screen is symmetric. The fold lines are formed by extending a joining openings through the body in a line which allows the portions of the body to bend/fold relative to each other much easier than other portions of the body. The fold lines are placed in consideration of the designs of various urinal basins known to be used to allow the urinal screen to fit into urinal basins without unwanted movement that can occur with flushing.

The claims appended hereto are meant to cover all modifications and changes within the scope and spirit of the present invention.

What is claimed is:

1. A urinal screen, comprising:

a body sheet having a kite shape including a perimeter defining a front apex, a rear apex, a first side apex, and a second side apex, a longitudinal axis defined from the front apex to the rear apex, a crosswise axis defined from the first side apex to the second side apex, wherein the longitudinal axis and the crosswise axis are at a right angle to each other, wherein the body sheet is symmetric about the longitudinal axis and asymmetric about the crosswise axis and wherein the crosswise axis is closer to the rear apex than to the front apex, the body sheet formed of a material, the material being flexible;

an interior of the body sheet being a web of openings through the body sheet bounded by intersecting lines of material forming a plurality of nodes where lines of material intersect and a plurality of links between nodes along sides of openings;

a plurality of protrusions formed on the lines of material on a top side of the body sheet; and a crosswise fold line formed along the crosswise axis wherein portions of the lines of material are broken along the crosswise fold line.

2. The urinal screen of claim 1, further comprising at least one longitudinal fold line formed parallel to the longitudinal axis wherein portions of the lines of material are broken along the at least one longitudinal fold line.

3. The urinal screen of claim 2, wherein the at least one longitudinal fold line comprises two longitudinal fold lines include a first longitudinal fold line and second longitudinal fold line, wherein the first and second longitudinal fold lines are located on opposite sides of the longitudinal axis and are equidistant from the longitudinal axis.

4. The urinal screen of claim 1, wherein the plurality of protrusions include:

a first plurality of protrusions wherein each protrusion of the first plurality of protrusions is located at a respective one of the plurality of nodes; and a second plurality of protrusions wherein each protrusion of the second plurality of protrusions is located at a respective one of the plurality of links.

5. The urinal screen of claim 4, wherein the first plurality of protrusions have a first height, the second plurality of protrusions have a second height, and wherein the first height and the second height are different.

6. The urinal screen of claim 1, wherein each of the openings has a regular rhombus shape and each of the openings are commonly oriented.

7. The urinal screen of claim 1, further comprising, on a bottom side of the body sheet, opposite the top side of the body sheet:

at least one forward diverter wall that extends from the bottom side of the body sheet along the longitudinal fold line between the crosswise fold line and the front apex;

at least one rearward diverter wall that extends from the bottom side of the body sheet along the longitudinal fold line between the crosswise fold line and the rear apex; and a suction cup support positioned along the longitudinal axis between the at least one rearward diverter wall and the rear apex that includes a support wall that extends from the bottom side of the body sheet to a tab that extends away from the support wall in a direction towards the rear apex.

8. The urinal screen of claim 7, further comprising:

at least two forward standoffs extending from the bottom side of the body sheet between the crosswise fold line and the front apex and on opposite sides of the longitudinal fold lines; and at least two rearward standoffs extending from the bottom side of the body sheet between the crosswise fold line and the rear apex and on opposite sides of the longitudinal fold lines, wherein the at least two rearward standoffs extend farther from the bottom side of the body sheet than the at least two forward standoffs.

9. A urinal screen, comprising:

a body sheet having a kite shape including a perimeter defining a front apex, a rear apex, a first side apex, and a second side apex, a longitudinal axis defined from the front apex to the rear apex, a crosswise axis defined from the first side apex to the second side apex, wherein the longitudinal axis and the crosswise axis are at a right angle to each other, wherein the body sheet is symmetric about the longitudinal axis and asymmetric about the crosswise axis and wherein the crosswise axis is closer to the rear apex than to the front apex, the body sheet formed of a material, the material being flexible, wherein the front apex is rounded, and the perimeter between the first side apex and a first side of the front apex curves inward relative to a straight line between the first side apex and the first side of the front apex, and the perimeter between the second side apex and a second side of the front apex curves inward relative to a straight line between the second side apex and the second side of the front apex;

an interior of the body sheet being a web of openings through the body sheet bounded by intersecting lines of material forming a plurality of nodes where lines of material intersect and a plurality of links between nodes along sides of openings;

a plurality of protrusions formed on the lines of material on a top side of the body sheet; and a crosswise fold line formed parallel to the crosswise axis wherein portions of the lines of material are broken along the crosswise fold line.

10. The urinal screen of claim 9, further comprising at least one longitudinal fold line formed parallel to the longitudinal axis wherein portions of the lines of material are broken along the at least one longitudinal fold line.

11. The urinal screen of claim 10, wherein the at least one longitudinal fold line comprises two longitudinal fold lines include a first longitudinal fold line and second longitudinal fold line, wherein the first and second longitudinal fold lines are located on opposite sides of the longitudinal axis and are equidistant from the longitudinal axis.

12. The urinal screen of claim 9, wherein the plurality of protrusions include:

a first plurality of protrusions wherein each protrusion of the first plurality of protrusions is located at a respective one of the plurality of nodes; and a second plurality of protrusions wherein each protrusion of the second plurality of protrusions is located at a respective one of the plurality of links.

13. The urinal screen of claim 12, wherein the first plurality of protrusions have a first height, the second plurality of protrusions have a second height, and wherein the first height and the second height are different.

14. The urinal screen of claim 9, wherein each of the openings has a regular rhombus shape and each of the openings are commonly oriented.

15. The urinal screen of claim 9, further comprising, on a bottom side of the body sheet, opposite the top side of the body sheet:

at least one forward diverter wall that extends from the bottom side of the body sheet along the longitudinal fold line between the crosswise fold line and the front apex;

at least one rearward diverter wall that extends from the bottom side of the body sheet along the longitudinal fold line between the crosswise fold line and the rear apex; and a suction cup support positioned along the longitudinal axis between the at least one rearward diverter wall and the rear apex that includes a support wall that extends from the bottom side of the body sheet to a tab that extends away from the support wall in a direction towards the rear apex.

16. The urinal screen of claim 15, further comprising:

at least two forward standoffs extending from the bottom side of the body sheet between the crosswise fold line and the front apex and on opposite sides of the longitudinal fold lines; and at least two rearward standoffs extending from the bottom side of the body sheet between the crosswise fold line and the rear apex and on opposite sides of the longitudinal fold lines, wherein the at least two rearward standoffs extend farther from the bottom side of the body sheet than the at least two forward standoffs.

17. The urinal screen of claim 9, wherein the body sheet comprises a flat region of material proximate to the rear apex wherein the top side of the body sheet lacks protrusions or openings.

18. The urinal screen of claim 9, further including a boundary of material along the perimeter.

19. The urinal screen of claim 18, wherein the boundary has one or two break along the perimeter between the first side apex and the front apex and the second side apex and the front apex.

20. A urinal screen, comprising:

a body sheet having a longitudinal axis defined from a front apex to a rear apex, a crosswise axis defined from a first side apex to a second side apex, wherein the longitudinal axis and the crosswise axis are at a right angle to each other, wherein the body sheet is symmetric about the longitudinal axis and asymmetric about the crosswise axis and wherein the crosswise axis is closer to the rear apex than to the front apex, the body sheet formed of a flexible material;

an interior of the body sheet comprised of a web of openings through the body sheet, the openings each being bounded by lines of material forming a plurality of nodes where lines of material intersect, and wherein the lines of material form a plurality of links between the nodes;

a plurality of protrusions formed on the lines of material on a top side of the body sheet;

a crosswise fold line formed along the crosswise axis wherein portions of the lines of material are omitted along the crosswise fold line to join two or more adjacent ones of the openings to create extended openings in a plurality of locations along the crosswise fold line;

at least one forward diverter wall that extends from a bottom side of the body sheet along the longitudinal fold line between the crosswise fold line and the front apex;

at least one rearward diverter wall that extends from the bottom side of the body sheet along the longitudinal fold line between the crosswise fold line and the rear apex; and a suction cup support positioned along the longitudinal axis between the at least one rearward diverter wall and the rear apex that includes a support wall that extends from the bottom side of the body sheet to a tab that extends away from the support wall in a direction towards the rear apex.

* * * * *